US007588456B2

(12) United States Patent
Zhu et al.

(10) Patent No.: US 7,588,456 B2
(45) Date of Patent: Sep. 15, 2009

(54) ELECTRICAL CONNECTOR WITH IMPROVED HEAT DISSIPATION STRUCTURE

(75) Inventors: Zi-Qiang Zhu, Kunshan (CN); Chen-Xi Wang, Kunshan (CN); Zhang-Lan Xue, Kunshan (CN); Hong-Qiang Han, Kunshan (CN); Lun-Song Hu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/316,324

(22) Filed: Dec. 11, 2008

(65) Prior Publication Data

US 2009/0149060 A1 Jun. 11, 2009

(30) Foreign Application Priority Data

Dec. 11, 2007 (CN) ..... 2007 2 0131359

(51) Int. Cl.
*H01R 13/00* (2006.01)

(52) U.S. Cl. ..... 439/485

(58) Field of Classification Search ..... 439/485, 439/607, 487

See application file for complete search history.

(56) References Cited

U.S. PATENT DOCUMENTS 6,077,115 A * 6/2000 Yang et al. ..... 439/567

6,932,647 B2 8/2005 Murayama

FOREIGN PATENT DOCUMENTS

TW M267687 6/2005

* cited by examiner

*Primary Examiner*—Javaid Nasri
(74) *Attorney, Agent, or Firm*—Wei Te Chung

(57) ABSTRACT

An electrical connector includes an insulative housing (2) having a base portion (20) with a front face (200) and a rear face (204), and a protection portion (22) extending backwardly from the rear face (204). The protection portion (22) defines a receiving cavity (222) opening at a rear end thereof. The base portion (20) defines a plurality of passageways (201) extending therethrough and communicating with the receiving cavity (222). A plurality of power contacts (3) are retained on the insulative housing (2). Each power contact (3) has a securing portion (300, 310) positioned in the passageway (201), a columned contact portion (301, 311) and a bending portion (302, 312) extending from two ends of the securing portion (300, 310) respectively. The bending portion (302, 312) is received in the receiving cavity (222) for dissipating heat best. A metal shield (4) has a flat portion (40) affixed to the front face (200) and a mating portion (41) extending forwardly from the flat portion (40). The mating portion (41) defines a D-shape mating hole (42) for receiving a mating connector.

13 Claims, 5 Drawing Sheets

ELECTRICAL CONNECTOR WITH IMPROVED HEAT DISSIPATION STRUCTURE

BACKGROUND OF THE INVENTION

1. Field of the Invention

The present invention relates to an electrical connector, and more particularly to an electrical connector with improved heat dissipation structure.

2. Description of Related Art

In recent years, an electronic apparatus such as a computer, a sever, a printer, and an exchange is remarkably widespread. Since the electronic apparatus of the type transmits a high-speed electronic signal and needs a mass of power, a connector used as an I/O port of the apparatus is desired to have a good heat dissipation structure in process of power transmission for assuring a steady work of the apparatus.

An connector usually includes an insulative housing, a plurality of contacts mounted on the insulative housing and a metal shield for protecting the connector from disturbing. The insulative housing has a front face and a rear face. Each contact has a securing portion fixed in the insulative housing, a contact portion extending forwardly from the securing portion, a soldering portion for connecting with a circuit board, and a bending portion between the securing portion and the soldering portion. The bending portion is usually exposed to air for dissipating heat well.

However, the exposed bending portions are easily hit to contact with each other and results in crosstalk with each other. TW. Pat. Issued No. M267687 discloses an electrical connector which solves the above problem. The electrical connector includes an insulative housing with a plurality of contacts retained thereon, a metal shield mounted on a front position of the insulative housing and a rear cover mounted on a back position of the insulative housing and covering the contacts. Thereby, the contacts are protected from hitting by the rear cover. However, firstly, the rear cover is separated from the insulative housing, thereby a procedure in assembly is increased, and production cost is increased too; secondly, the contacts can not dissipate heat best when they are covered by the rear cover, thereby the electrical connector is easily burned out.

Hence, an electrical connector which can protect contacts, and has a simple structure, and dissipate heat best, is desired to overcome the disadvantage of the prior art.

BRIEF SUMMARY OF THE INVENTION

According to the present invention, an electrical connector comprises an insulative housing, a plurality of power contacts retained on the insulative housing, and a metal shield covering the insulative housing. The insulative housing has a base portion with a front face and a rear face, and a protection portion extending backwardly from the rear face. The protection portion defines a receiving cavity opening at a rear end thereof. The base portion defines a plurality of passageways extending therethrough and communicating with the receiving cavity. Each power contact has a securing portion positioned in the passageway, a columned contact portion and a bending portion extending from two opposite ends of the securing portion respectively. The bending portion is received in the receiving cavity. The metal shield has a flat portion affixed to the front face and a mating portion extending forwardly from the flat portion. The mating portion defines a D-shape mating hole for receiving a mating connector.

According to another aspect of the present invention, an electrical connector comprises an insulative housing, a plurality of power contacts mounted on the insulative housing, and a metal shield. The insulative housing has a front face and a back face opposite to the front face. The insulative housing defines a plurality of passageways extending therethrough. A trapeziform projection extends forwardly from the front face and defines a groove communicating with the passageway. The power contacts comprise a pair of first contacts and a second contact located between the first contacts. Each power contact has a securing portion engaging with the passageway and a contact portion extending out of the front face from one end of the securing portion. The metal shield has a flat portion affixed to the front face and a mating portion extending forwardly from the flat portion. The mating portion defines a mating hole surrounding the projection for receiving a mating connector. The contact portions of the first contacts are exposed to the mating hole. The contact portion of the second contact is received in the groove and defines a receiving hole extending inwardly from a front end thereof for receiving a contact of the mating connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
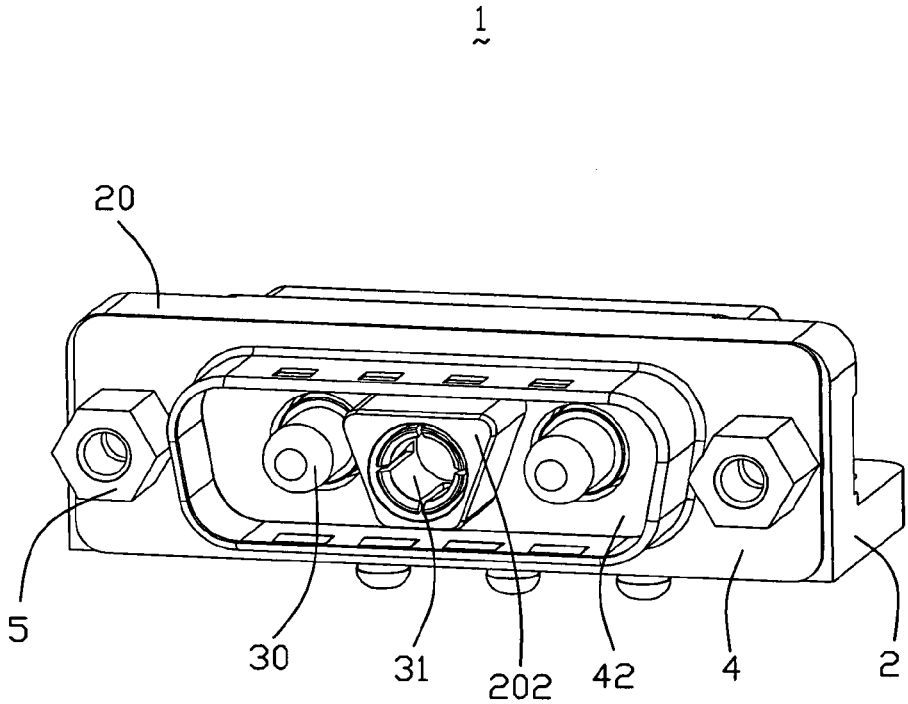
FIG. 1 is a perspective view of the preferred embodiment of an electrical connector according to the present invention.
Figure 2:
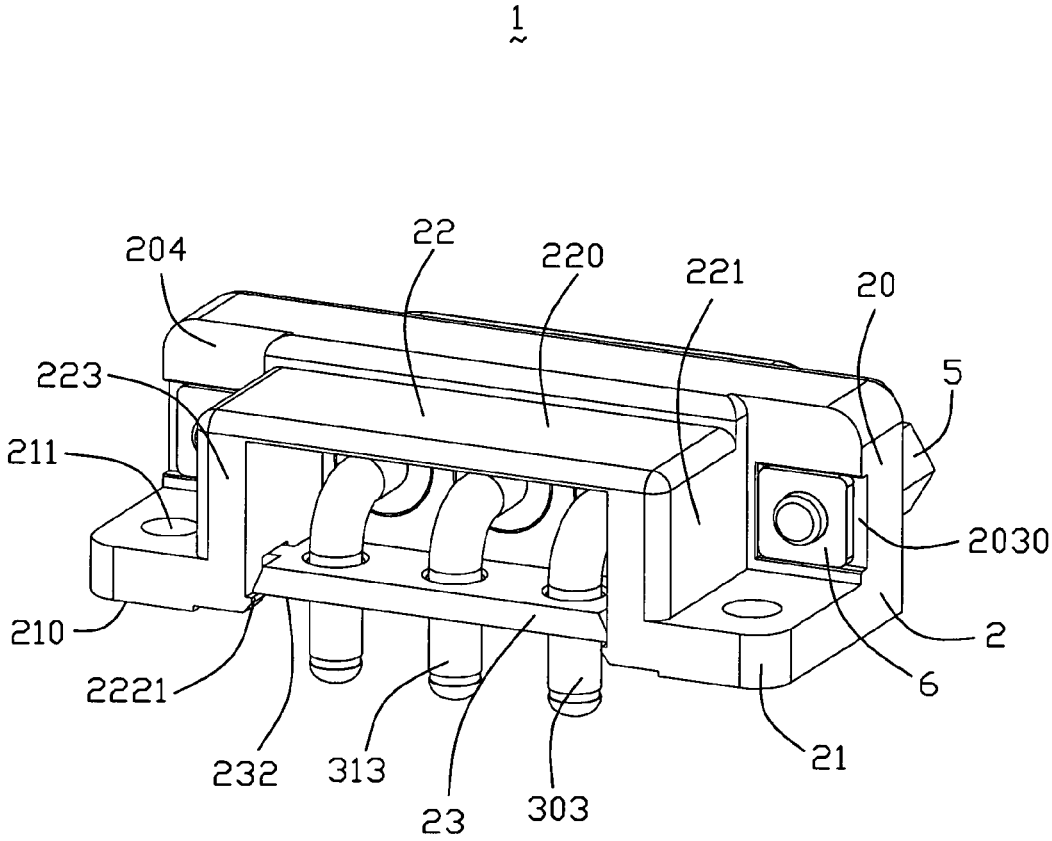
FIG. 2 is a view similar to FIG. 1, while taken from another aspect.
Figure 3:
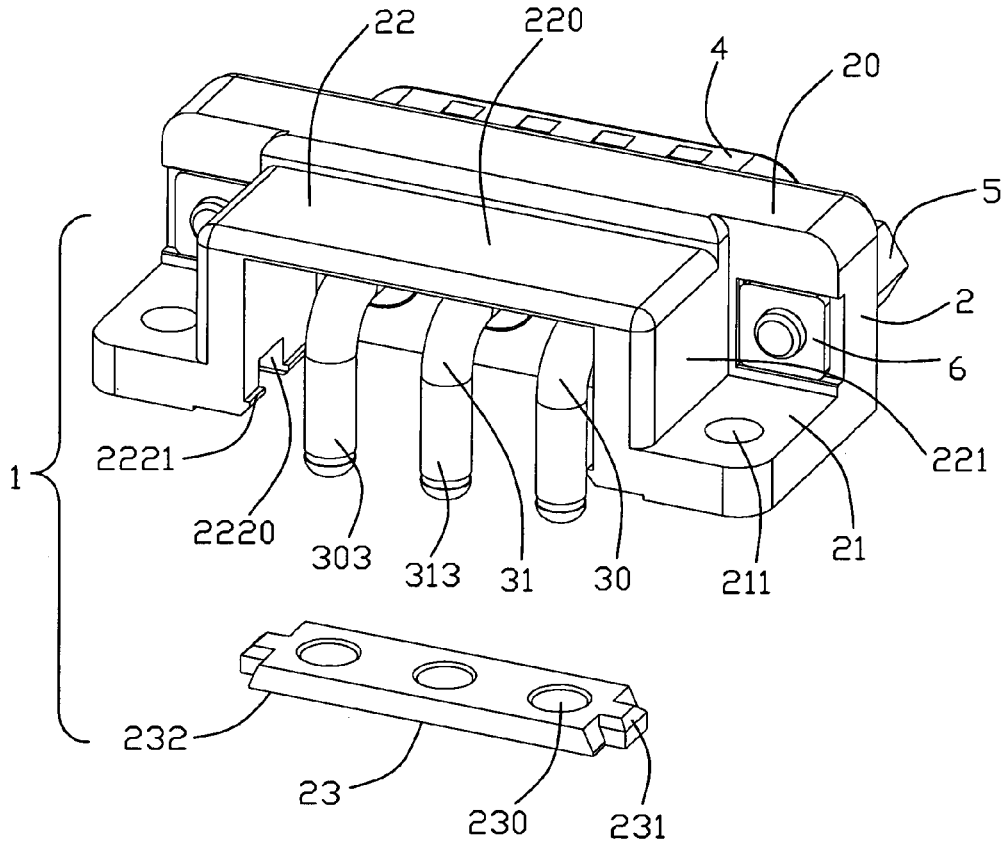
FIG. 3 is a partial exploded view of the Electrical connector shown in FIG. 1.

Referring to FIGS. 1-3, an electrical connector 1 according to the present invention is disclosed. The electrical connector 1 comprises an insulative housing 2, a plurality of contacts 3 retained in the insulative housing 2, a metal shield 4 mounted on the insulative housing 2 and means for fixing the insulative housing 2 and the metal shield 4 together.

Figure 4:
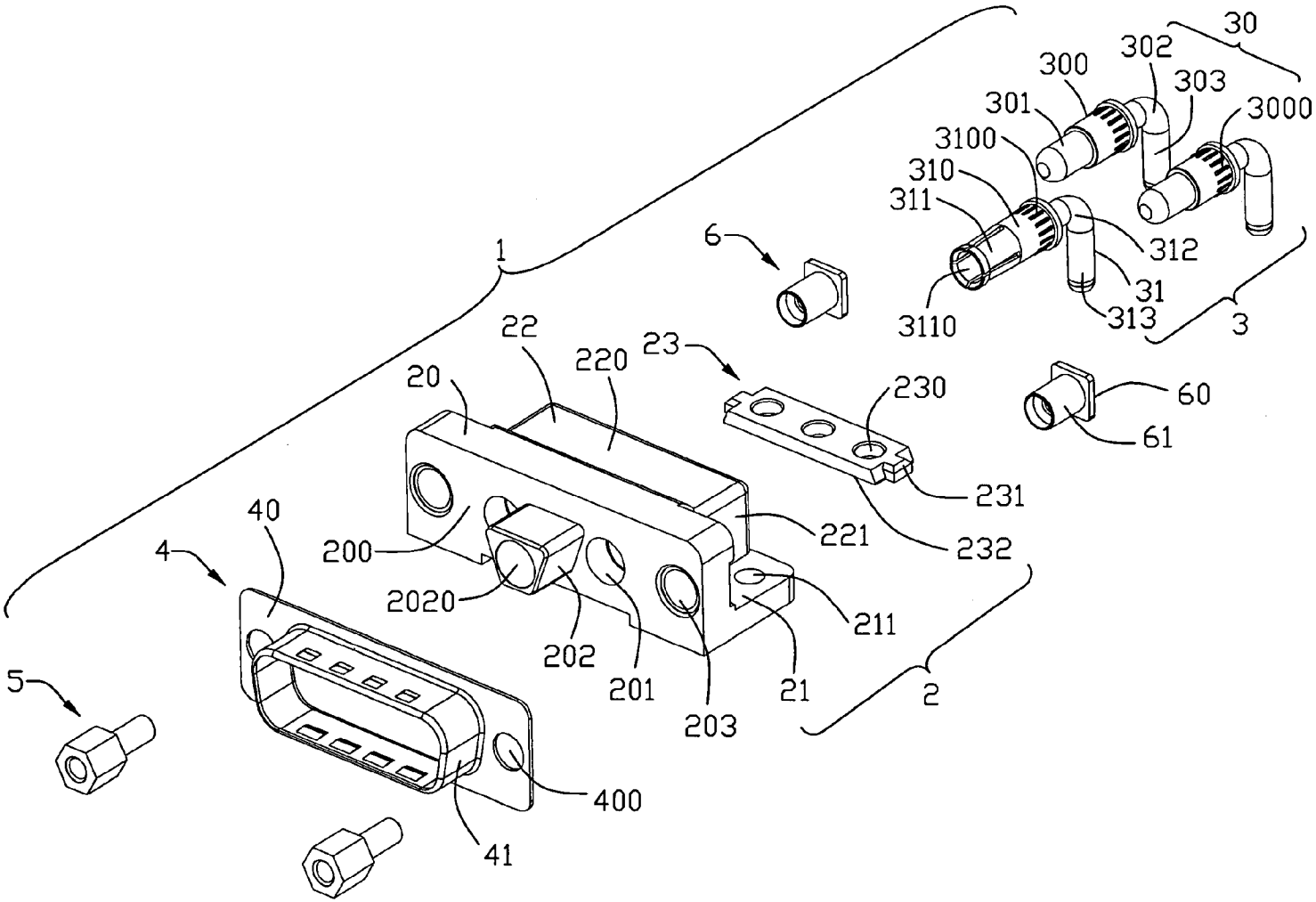
FIG. 4 is an exploded view of the Electrical connector shown in FIG. 1.
Figure 5:
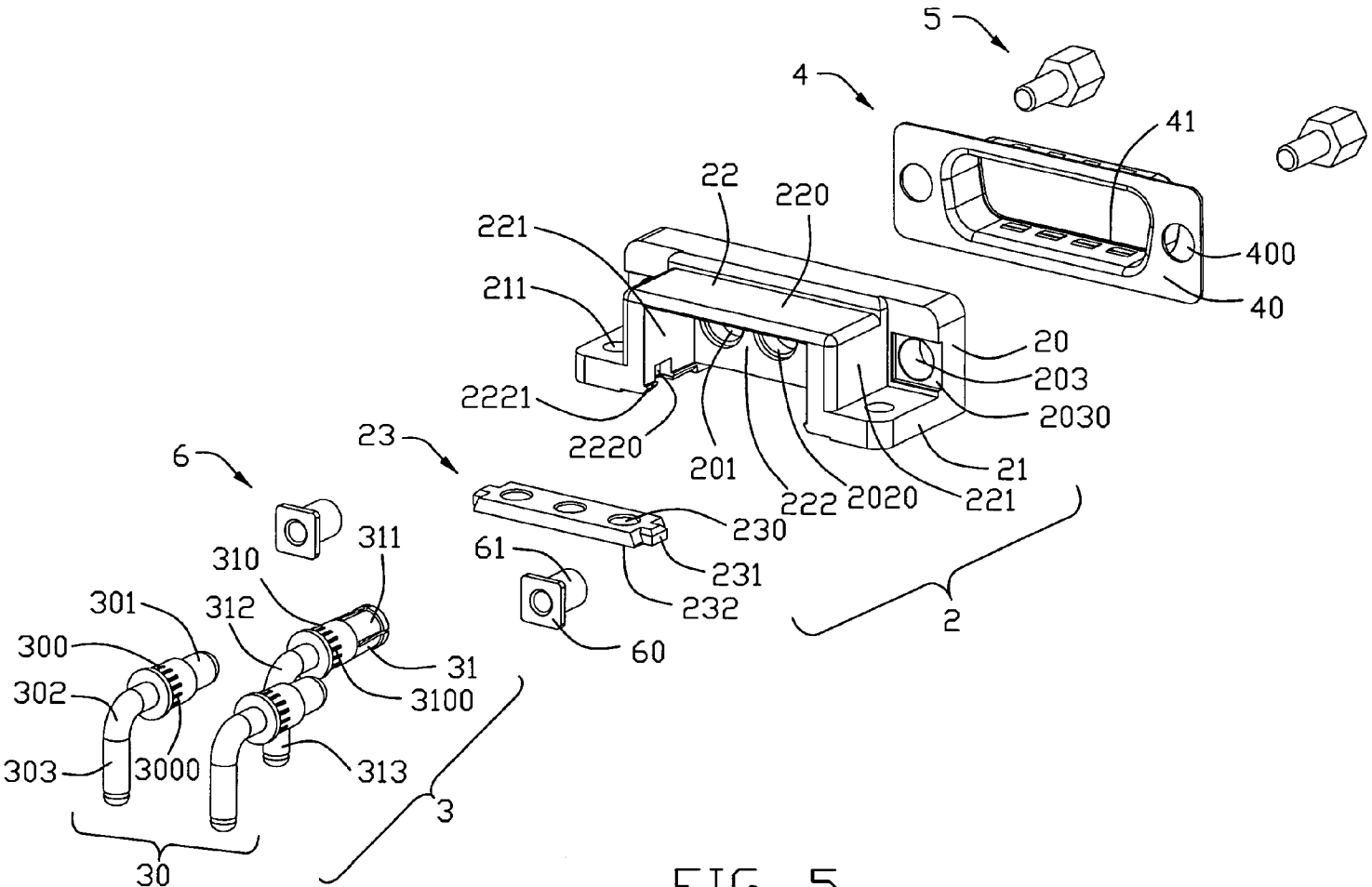
FIG. 5 is a view similar to FIG. 4, while taken from another aspect.

Referring to FIGS. 4 and 5, the insulative housing 2 comprises a base portion 20, a mounting portion 21 extending backwardly from a lower end of the base portion 20, and a protection portion 22 extending backwardly from the base portion 20 and connecting with the mounting portion 21. The base portion 20 has a front face 200 and a rear face 204 opposite to the front face 200. The insulative housing 2 comprises a trapeziform projection 202 extending forwardly from a middle position of the front face 200. An upper end of the projection 202 is bigger than a lower end of the projection 202 for protecting the electrical connector 1 from mismating. The projection 202 defines an annular groove 2020 extending inwardly from a front end thereof. The base portion 20 defines three annular passageways 201 extending therethrough, wherein a middle passageway 201 is located behind the groove 2020 and communicate with the groove 2020, and the other two passageways 201 locate at two sides of the middle one symmetrically. The base portion 20 defines two locking holes 203 at outside of the grooves 2020. A pair rectangular recesses 2030 are concaved from the rear face 204. The rectangular recess 2030 communicates with the locking hole 203. The mounting portion 21 comprises a mounting face 210 at a bottom side thereof, and a pair of mounting holes 211 extending through the mounting face 210 for positioning the electrical connector 1 to a circuit board (not shown).

The protection portion 22 comprises a top wall 220, a pair of side walls 221, a back face 223, and a receiving cavity 222 extending inwardly from the back face 223. The receiving cavity 222 is located between the top wall 220 and side walls 221, and opens to air at a rear end thereof and extends through the mounting face 210. Each side wall 221 defines a cutout 2220 at a lower end thereof, and a pair of wedge-shaped barbs 2221 at two sides of the cutout 2220.

The insulative housing 2 comprises a spacer 23 mounted at a lower position of the receiving cavity 222. The spacer 23 defines three positioning holes 230 for positioning the power contacts 3. Distances between adjacent positioning holes 230 are similar. The spacer 23 has a protrusion 231 extending outwardly from each side thereof for engaging with the cutout 2220. The spacer 23 has a bottom face 232. The barbs 2221 draw the bottom face 232 for fixing the spacer 23 between the side walls 221.

The metal shield 4 has a flat portion 40 affixed to the front face 200 of the base portion 20, and a D-shape mating portion 41 extending forwardly from the flat portion 40. The mating portion 41 defines a D-shape mating hole 42 for receiving a mating connector (not shown). The flat portion 40 defines a pair of fixing holes 400 corresponding to the locking holes 203 of the base portion 20.

The power contacts 3 are columned and comprise two first contacts 30 and a second contact 31 located between the first contacts 30. Each first contact 30 has a first securing portion 300, a columned first contact portion 301 extending forwardly from one end of the first securing portion 300, a first bending portion 302 extending backwardly from another end of the first securing portion 300, and a first soldering portion 303 extending downwardly from the first bending portion 302. The second contact 31 has a second securing portion 310, a second contact portion 311 extending forwardly from one end of the second securing portion 310, a second bending portion 312 extending backwardly from another end of the second securing portion 310, and a second soldering portion 313 extending downwardly from the second bending portion 312. The first and second contacts 30, 31 have similar structures except for the structures of the contact portions 301, 311 thereof. The difference between the first and second contact portions 301, 311 is that the second contact portion 311 defines a receiving hole 3110 extending inwardly from a front end thereof, while the first contact portion 301 dose not have, and the second contact portion 311 defines a diameter which is larger than that of the first contact portion 301.

The first contact portions 301 extend out of the front face 200 and are received in the mating hole 42 for electrically connecting with the mating connector. While the second contact portion 311 is received in the groove 2020 for receiving a contact of the mating portion in the receiving hole 3110 thereof. The first securing portion 300 is columned and has a plurality of first ribs 3000 at outer surfaces thereof for engaging with the passageway 201. The second securing portion 310 is columned and has a plurality of second ribs 3100 at outer surfaces thereof for engaging with the middle passageway 201 behind the groove 2020. Therefore, the power contacts 3 can be fixed to the insulative housing 1 firmly and can not move in any direction. The first and second bending portions 302, 312 are received in the receiving cavity 222, thereby the first and second bending portion 302, 312 can be protected from distorting by the top wall 220 and side walls 221. In addition, the first and second bending portion 302, 312 are exposed to air via the opening receiving cavity 222, thereby, the power contact 3 will dissipate heat best. The first and second soldering portions 303, 313 extend through the positioning holes 230 for exactly soldering to the circuit board.

The first and second securing portions 300, 310 define a same diameter which is larger than them of the first and second contact portions 301, 311. The diameters of first and second contact portions 301, 311 are larger than them of the first and second soldering portions 303, 313.

Means for fixing the metal shield 4 and the insulative housing 2 comprises a bolt 5 and a nut 6 engaging with the bolt 5. The nut 6 has a holding plate 60 retained in the recess 2030, and a ringed post 61 extending forwardly from the holding plate 60. The ringed post 61 extends through the locking hole 203 and the fixing hole 400 from a rear side of the electrical connector 1. The bolt 5 is mounted to the ringed post 61 from a front side of the electrical connector 1.

As fully described above and referring to FIGS. 1-5 of the present invention, the power contacts 3 have larger contact area to contact with the mating connector than an original contact, thereby the power contacts 3 of the present invention can transmit a mass of current. The first and second bending portions 302, 312 are exposed to air via the rear opening receiving cavity 222, thereby the power contact 3 will dissipate heat best for prolonging life thereof. In addition, the protection portion 22 is integrally molded with the base portion 20, thereby the electrical connector 1 has a simple structure, and can be assembled easily which can decrease the production cost.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising: an insulative housing having a base portion with a front face and a rear face, and a protection portion extending backwardly from the rear face, the protection portion defining a receiving cavity opening at a rear end thereof, the base portion defining a plurality of passageways extending therethrough and communicating with the receiving cavity; a plurality of power contacts retained on the insulative housing, each power contact having a securing portion positioned in the passageway, a columned contact portion and a bending portion extending from one end of the securing portion respectively, the bending portion being received in the receiving cavity; and a metal shield having a fiat portion affixed to the front face and a mating portion extending forwardly from the fiat portion, the mating portion defining a D-shape mating hole for receiving a mating connector; wherein the insulative housing has a trapeziform projection extending to the mating hole from a middle position of the front face, the projection defines a groove communicating with the passageway; wherein the power contacts comprises a pair of first contacts and a second contact located between the first contacts, wherein the contact portion of the second contact defines a receiving hole extending backwardly from a front end thereof and is received in the groove; wherein the contact portions of the first contacts extend to the mating hole and are exposed to the mating hole.

2. The electrical connector according to claim 1, wherein the protection portion comprises a top wall and a pair of side walls, the receiving cavity is located between the top wall and side walls.

3. The electrical connector according to claim 2, wherein the insulative housing has a mounting portion extending backwardly from a lower end of the base portion, and the mounting portion has a mounting face at a bottom side thereof, wherein the receiving cavity extends through the mounting face.

4. The electrical connector according to claim 1, wherein the securing portions are columned, the securing portions defines a diameter which is larger than that of the contact portions.

5. The electrical connector according to claim 4, wherein each power contact has a soldering portion extending downwardly from the bending portion, the bending portion and soldering portion are columned and define a same diameter.

6. The electrical connector according to claim 5, wherein the diameter of the contact portion is larger than that of the soldering portion.

7. The electrical connector according to claim 5, further comprising a spacer positioning on a lower side of the protection portion, the spacer defines a plurality of slots extending therethrough.

8. The electrical connector according to claim 1, wherein the securing portion has a plurality of ribs extending outwardly from outer surfaces thereof for engaging with the passageways.

9. An electrical connector, comprising:

an insulative housing having a front face and a back face opposite to the front face, the insulative housing defining a plurality of passageways extending therethrough, a trapeziform projection extending forwardly from the front face and defining a groove communicating with one of the plurality of passageways; and a plurality of power contacts mounted on the insulative housing, the power contacts comprising a pair of first contacts and a second contact located between the first contacts, each power contact having a securing portion engaging with respective passageway of the plurality of passageways and a contact portion extending out of the front face from one end of the securing portion; and a metal shield having a flat portion affixed to the front face and a mating portion extending forwardly from the flat portion, the mating portion defining a mating hole surrounding the projection for receiving a mating connector;

wherein the contact portions of the first contacts are exposed to the mating hole, and the contact portion of the second contact is received in the groove and defines a receiving hole extending inwardly from a front end thereof for receiving a contact of the mating connector.

10. The electrical connector according to claim 9, wherein the projection extends from a middle position of the front face, and the groove extends inwardly from a front end of the projection.

11. The electrical connector according to claim 10, wherein an upper end of the projection is bigger than a lower end of the projection.

12. The electrical connector according to claim 10, wherein the power contacts are columned, and the contact portion of the second contact defines a diameter which is larger than that of the contact portions of each of the first contacts, and the securing portions of each of the power contacts defines a diameter which is larger than the contact portions of each of the power contacts.

13. The electrical connector according to claim 9, wherein the insulative housing defines a receiving cavity extending inwardly from the back face, and the receiving cavity is communicating with the passageways, and wherein each power contact has a bending portion extending from another end of the securing portion and received in the receiving cavity.

* * * * *